US006375189B1

(12) United States Patent
Jones

(10) Patent No.: US 6,375,189 B1
(45) Date of Patent: Apr. 23, 2002

(54) METHODS FOR PROVIDING A JACKPOT COMPONENT IN A CASINO GAME IN WHICH AN INITIAL SET OF CARDS AND ADDITIONAL CARDS ARE DEALT

(75) Inventor: Donald W. Jones, Coral Springs, FL (US)

(73) Assignee: Progressive Games, Inc., Las Vegas, NV (US)

( * ) Notice: Subject to any disclaimer, the term of this patent is extended or adjusted under 35 U.S.C. 154(b) by 0 days.

(21) Appl. No.: 09/547,600

(22) Filed: Apr. 11, 2000

Related U.S. Application Data

(63) Continuation of application No. 08/975,148, filed on Nov. 20, 1997, now abandoned.

(51) Int. Cl.[7] ..... A63F 1/00
(52) U.S. Cl. ..... 273/292
(58) Field of Search ..... 273/292, 309, 273/274; 463/12, 13

(56) References Cited

U.S. PATENT DOCUMENTS

| | | | |
|---|---|---|---|
| 1,238,736 | A | 9/1917 | Barrett |
| 1,527,929 | A | 2/1925 | Simons |
| 1,763,476 | A | 6/1930 | Morris |
| 1,970,876 | A | 8/1934 | Anderson |
| 2,008,829 | A | 7/1935 | Israel |
| D105,610 | S | 8/1937 | Posey |
| D118,451 | S | 1/1940 | Radford |
| 2,199,745 | A | 5/1940 | Harris |
| D183,007 | S | 6/1958 | Lord |
| 3,011,789 | A | 12/1961 | Eliassen et al. |
| 3,269,503 | A | 8/1966 | Foster |
| D213,891 | S | 4/1969 | Schultz |
| 3,556,531 | A | 1/1971 | Elder |
| D220,635 | S | 5/1971 | Boyer et al. |
| 3,663,021 | A | 5/1972 | Whippo |
| 3,667,757 | A | 6/1972 | Holmberg |
| 3,689,071 | A | 9/1972 | Kucera |
| 3,796,433 | A | 3/1974 | Fraley et al. |
| 3,825,255 | A | 7/1974 | Kennard et al. |
| 3,874,671 | A | 4/1975 | Smith |
| 3,876,208 | A | 4/1975 | Wachtler et al. |
| 3,998,462 | A | 12/1976 | Goott |
| D245,717 | S | 9/1977 | Jessie |
| 4,063,680 | A | 12/1977 | Leo |
| 4,099,722 | A | 7/1978 | Rodesch et al. |
| 4,232,866 | A | 11/1980 | Pennachio |
| 4,302,012 | A | 11/1981 | Di Giovanni et al. |
| 4,305,586 | A | 12/1981 | Richards |
| 4,312,508 | A | 1/1982 | Wood |
| D263,975 | S | 4/1982 | Quisuga et al. |
| 4,364,567 | A | 12/1982 | Goott |
| 4,397,469 | A | 8/1983 | Carter, III |
| 4,518,001 | A | 5/1985 | Branham |
| 4,531,187 | A | 7/1985 | Uhland |
| 4,569,526 | A | 2/1986 | Hamilton |
| 4,575,085 | A | 3/1986 | Ollington |
| 4,614,342 | A | 9/1986 | Takashima |
| 4,624,459 | A | 11/1986 | Kaufman |
| 4,648,604 | A | 3/1987 | Horan |
| 4,651,997 | A | 3/1987 | Wood |
| 4,666,160 | A | 5/1987 | Hamiton |
| 4,700,948 | A | 10/1987 | Okada |
| 4,721,307 | A | 1/1988 | Okada |
| 4,743,022 | A | 5/1988 | Wood |
| 4,756,531 | A | 7/1988 | DiRe et al. |
| 4,759,549 | A | 7/1988 | Beckwith |
| 4,760,527 | A | 7/1988 | Sidley |
| 4,813,675 | A | 3/1989 | Greenwood |
| 4,836,546 | A | 6/1989 | DiRe et al. |
| 4,836,553 | A | 6/1989 | Suttle et al. |
| 4,837,728 | A | 6/1989 | Barrie et al. |
| 4,861,041 | A | 8/1989 | Jones et al. |
| 4,926,327 | A | 5/1990 | Sidley |
| 4,948,134 | A | 8/1990 | Suttle et al. |
| D311,474 | S | 10/1990 | Hoffman |
| 4,964,638 | A | 10/1990 | Ishida |
| 5,007,519 | A | 4/1991 | Mercurio |
| 5,019,973 | A | 5/1991 | Wilcox et al. |
| 5,022,653 | A | 6/1991 | Suttle et al. |
| 5,042,818 | A | 8/1991 | Weingardt |
| 5,078,405 | A | 1/1992 | Jones et al. |
| 5,092,598 | A | 3/1992 | Kamille |
| 5,098,107 | A | 3/1992 | Boylan et al. |
| 5,100,137 | A | 3/1992 | Fulton |
| 5,106,089 | A | 4/1992 | Wood |
| 5,112,060 | A | 5/1992 | Jones |
| 5,154,429 | A | 10/1992 | Le Vasseur |
| 5,167,413 | A | 12/1992 | Fulton |
| 5,248,142 | A | 9/1993 | Breeding |
| 5,249,800 | A | 10/1993 | Hilgendorf et al. |
| 5,251,897 | A | 10/1993 | Fulton |
| 5,255,915 | A | 10/1993 | Miller |
| 5,257,784 | A | 11/1993 | Boylan et al. |
| 5,257,810 | A | 11/1993 | Schorr et al. |
| 5,265,877 | A | 11/1993 | Boylan et al. |
| 5,275,400 | A | 1/1994 | Weingardt et al. |
| 5,275,411 | A | 1/1994 | Breeding |

(List continued on next page.)

FOREIGN PATENT DOCUMENTS

| | | |
|---|---|---|
| AT | 96049 | 4/1989 |
| AU | 621599 | 4/1989 |
| AU | 628044 | 4/1989 |

(List continued on next page.)

OTHER PUBLICATIONS

Winning Gamer, Issue #5, Feb. 1985, Pi Yee Press, LaJolla, CA.

Winning Gamer, Issue #6, Mar. 1985, Pi Yee Press, LaJolla, CA.

(List continued on next page.)

*Primary Examiner*—Benjamin H. Layno

(57) ABSTRACT

In a casino card game, provisions are made for a jackpot component awarded after initially dealt cards are reviewed and additional cards are dealt, in which predetermined prizes are awarded players who participate in the jackpot component by placing additional wagers and the prizes are based upon preselected arrangements of playing cards in the hands after additional cards are dealt.

48 Claims, No Drawings

U.S. PATENT DOCUMENTS

| | | | |
|---|---|---|---|
| 5,275,415 | A | 1/1994 | Wisted |
| 5,277,424 | A | 1/1994 | Wilms |
| 5,286,023 | A | 2/1994 | Wood |
| 5,288,077 | A | 2/1994 | Jones |
| 5,288,081 | A | 2/1994 | Breeding |
| 5,294,128 | A | 3/1994 | Marquez |
| 5,322,295 | A | 6/1994 | Cabot et al. |
| 5,364,104 | A | 11/1994 | Jones et al. |
| 5,364,105 | A | 11/1994 | Jones |
| 5,374,067 | A | 12/1994 | Jones |
| 5,377,973 | A | 1/1995 | Jones |
| 5,377,994 | A | 1/1995 | Jones |
| 5,380,012 | A | 1/1995 | Jones et al. |
| 5,382,025 | A | 1/1995 | Sklansky et al. |
| 5,390,934 | A | 2/1995 | Grassa |
| 5,393,067 | A | 2/1995 | Paulsen et al. |
| 5,401,023 | A | 3/1995 | Wood |
| 5,411,257 | A | 5/1995 | Fulton |
| 5,417,430 | A | 5/1995 | Breeding |
| 5,437,462 | A | 8/1995 | Breeding |
| 5,445,391 | A | 8/1995 | Gleason, Jr. |
| 5,472,194 | A | 12/1995 | Breeding et al. |
| 5,489,101 | A | 2/1996 | Moody |
| 5,494,296 | A | 2/1996 | Grassa |
| 5,511,781 | A | 4/1996 | Wood et al. |
| 5,531,448 | A | 7/1996 | Moody |
| 5,536,016 | A | 7/1996 | Thompson |
| 5,573,245 | A | 11/1996 | Weiner et al. |
| 5,577,731 | A | 11/1996 | Jones |
| 5,584,485 | A | 12/1996 | Jones et al. |
| 5,597,162 | A | 1/1997 | Franklin |
| 5,605,504 | A | 2/1997 | Huang |
| 5,626,341 | A | 5/1997 | Jones et al. |
| 5,636,843 | A | 6/1997 | Roberts |
| 5,664,781 | A | 9/1997 | Feola |
| 5,695,402 | A | 12/1997 | Stupak |
| 5,713,573 | A | 2/1998 | Nazaryan |
| 5,718,631 | A | 2/1998 | Invencion |
| 5,725,216 | A | 3/1998 | Jones |
| 5,732,950 | A | 3/1998 | Moody |
| 5,743,798 | A | 4/1998 | Adams et al. |
| 5,755,621 | A | 5/1998 | Marks et al. |
| 5,770,533 | A | 6/1998 | Franchi |
| 5,772,211 | A | 6/1998 | Nazaryan et al. |
| 5,775,992 | A | 7/1998 | Wood et al. |
| 5,785,593 | A | 7/1998 | Wood et al. |
| 5,788,241 | A | 8/1998 | Ung |
| 5,794,964 | A | 8/1998 | Jones et al. |
| 5,795,225 | A | 8/1998 | Jones et al. |
| 5,803,809 | A | 9/1998 | Yoseloff |
| 5,810,361 | A | 9/1998 | Kadlic |
| 5,823,873 | A | 10/1998 | Moody |
| 5,839,730 | A | 11/1998 | Pike |
| 5,839,731 | A | 11/1998 | Feola |
| 5,842,698 | A | 12/1998 | Brown |
| 5,845,906 | A | 12/1998 | Wirth |
| 5,851,147 | A | 12/1998 | Stupak et al. |
| 5,851,148 | A | 12/1998 | Brune et al. |
| 5,868,618 | A | 2/1999 | Netley et al. |
| 5,868,619 | A | 2/1999 | Wood et al. |
| 5,882,259 | A | 3/1999 | Holmes, Jr. et al. |
| 5,882,260 | A | 3/1999 | Markes et al. |

FOREIGN PATENT DOCUMENTS

| | | |
|---|---|---|
| CA | 1334983 | 3/1995 |
| CA | 1335381 | 4/1995 |
| DE | 2830216 | 1/1980 |
| DE | 3003376 | 8/1981 |
| DE | 68909992 | 4/1989 |
| DO | 4792 | 6/1991 |
| DO | 4793 | 6/1991 |
| DO | 4825 | 3/1993 |
| DO | 4999 | 9/1993 |
| EP | 03384029 | 4/1989 |
| GB | 2177610 A | 7/1985 |
| IT | 0338644 | 4/1989 |
| JP | 135187 | 6/1988 |
| JP | 4-371186 | of 1991 |
| UA | 2083936 | 3/1982 |
| UA | 2097570 | 11/1982 |
| UA | 2169736 | 7/1986 |
| UA | 2184029 | 6/1987 |
| WO | 93/10869 | 6/1993 |
| WO | 94/15684 | 7/1994 |
| WO | 95/21665 | 8/1995 |
| WO | 97/13562 | 4/1997 |
| WO | 92/20417 | 11/1997 |

OTHER PUBLICATIONS

Winning Gamer, Issue #15, Dec. 1985, Pi Yee Press, LaJolla, CA.
Winning Gamer, Issue #19, Apr. 1986, Pi Yee Press, La Jolla, CA.
Winning Gamer, Issue #20, May 1986, Pi Ye Press, La Jolla, CA.
Winning Gamer, Issue #21, Jun. 1986, Pi Ye Press, La Jolla, CA.
Affidavit of John F. Acres, Oct. 4, 1993.
Affidavit of William Randal Adams, Oct. 4, 1993.
Affidavit of Derell M. Johns, Nov. 19, 1993.
Affidavit of Terry Oliver, Nov. 22, 1993.
Affidavit of Nick Edward Greenwood, Nov. 23, 1993.
Affidavit of Michael Spencer Stone, Nov. 23, 1993.
Scarne, Scarne's Encyclopedia of Games, Harper & Row, N.Y., Copyright 1973, p. 381, 383 and title pages.
Scarne, Scarne's Encyclopedia of Games, Harper & Row, N.Y., Copyright 1973, p. 33–41 and title pages.
Scarne, Scarne's New Complete Guide To Gambling, Simon & Schuster, N.Y., Copyright 1961, p. 440–445.
Scarne, Scarne's Encyclopedia of Games, Harper & Row, N.Y.,Copyright 1983, p. 299–305; 383 and title pages.
W.E. Gibson, Hoyle's Modern Encyclopedia of Card Games, p. 218–9, 369–70 (1974).
Casino Player, vol. IV, No. 12, Aug. 1993, "My Biggest Slot Jackpot", Stanford Wong.
Gaming Concepts, Inc. "Over/Under 13 Blackjack" brochure, 1988.
Casino Gaming, Sep. 1988, "Aruba Deals a New Game: Caribbean Stud Poker", p. 12–13.
Casino Journal, vol. 8, No. 12. Dec. 1992, "Working Within the Systems: IGT's linked progressive programs take leap to the tables", p. 10–15, 40, 41.
Casino Journal, vol. 8, No. 6, Jun. 1993, "So You Want to be a Gambler", p. 1, 5.
Las Vegas Sun "A New Game Introduced" Mar. 5, 1982.
Las Vegas Sportsbook "Sklansky Invents New Casino Games" Mar. 19–25, 1982.
Vegas World "Casino Poker".
Sklansky "Casino Poker" rule card, TX899,489, copyrighted Apr. 4, 1982.
Bob Stupak's Vegas World "Casino Poker Rules".
Information Disclosure Statement, Apr. 7, 1988, describing "Sklansky's Casino Poker" and "Video Poker".
Coin Hopper Model CH–500 and Model Number CH–750–U1 literature Asahi Seiko.

Jan. 26, 1993 Satement of Grounds and Particulars, by John Huxley Ltd., in opposition to Australian Petition for patent Application No. 628044.
State of New Jersey Casino Control Commission PRN 217205 Civil Action, IGT's Second Amended Peitition for Authorization for the Implementation of the Game of Progressive 21, filed sometine after Aug. 4, 1992.
Review Journal, "Gamblers Take Chance at Million Dollar Payoff" by D.J. Boyer.
Winning Gamer, Issue #17, Feb. 1986, Pi Yee Press, La Jolla CA.
Scarne, Scarne's Encyclopedia of Games, "Hold'Em", Harper & Row Publisher, Copyright 1973, p. 14–18, 26.
Abercrobe & Fitch, Play Hours, 1960, p. 11, Blackjack Towel.
Scarne, Scarne's Encyclopedia of Games, copyright date unknown, p. 288.
Jim Kilby's Declaration under 37 C.F. R. 1.132.
TXU 184,603, Mar. 30, 1985.
Scarne, Scarne's Guide to Modern Poker, copyright unknown, p. 40, 60–61.
Request for Reexamination, U.S. Patent No. 4,861,041, Issued Aug. 29, 1989; date of service, Jun. 20, 1995.
Request for Reexamination, U.S. Patent No. 4,861,041, issued Aug. 29, 1989; date of service, Sep. 2, 1993.
Request for Reexamination, U.S. Patent No. 5,288,077, issued Feb. 22, 1994; date of service, May 26, 1995.
Request for Reexamination, U.S. Patent No. 5,364,105, issued Nov. 15, 1994; date of service, 5/296/95.
Sashi Seiko Catalog No. AV89C, Aug. 20, 1989; p. 44, 51 and Photograph "A ".
Scarnes, Scarne's Encyclopedia of Games, Copyright 1973, p. 11, 31, 440–445.
Declaration of I. Nelson Rose, dated Jan. 26, 1989.
Declaration of Don Clark, Dated Feb. 2, 1989.
Affidavit of Dennis Robie, dated Jan. 27, 1989.
Declaration of Mark A. Sincox, dated Feb. 7, 1989.
Declaration of John Edward Roethel, dated Feb. 7, 1989.
Commerce Casino Brochure Re Wisted' California Blackjack.
D&D Gaming Patent, Inc. v. Rio Properties, Inc. et al.: Case No.: CV–S–93–835–LDG–RLH; Defendants Request for Reexamination, U.S. Patent No. 5,377,973, issued Jan. 3, 1995.
PCT Written Opinion US 96/16409.
Royal Match 21 "Win Your Fortune" brochure, copyrighted 1991.
Fortune Card 21 "Win Your Fortune" brochure, copyrighted 1991.
Winning Gamer, Issue #17, Feb. 1986.
Over/Under 13 Blackjack brochure.
Official Rules of card Games, edited by A.H. Morehead, p. 78–93, copyright date 1968.
Specific Model Information Form FO–652–216.
Table Layout for "Casino Poker"Feb. 15, 1992.
TX 2 568 066 for Over/Under 13.
Supplement to Request for Reexam filed Under 1.510 served Mar. 25, 1998.

METHODS FOR PROVIDING A JACKPOT COMPONENT IN A CASINO GAME IN WHICH AN INITIAL SET OF CARDS AND ADDITIONAL CARDS ARE DEALT

CROSS REFERENCE TO RELATED APPLICATIONS

This application is a continuation of application Ser. No. 08/975,148, filed Nov. 20,1997 now abandoned. This application is generally related to the following applications and patents, each generally directed to methods and apparatus for playing casino card games including an additional jackpot feature.

Application Ser. No. 08/506,222 filed Jul. 24, 1995.

Application Ser. No. 08/486,700 filed Jun. 7, 1995; which is a continuation of application Ser. No. 08/337,661 filed Nov. 9, 1994; which is a division of application Ser. No. 08/040,925 filed Mar. 31, 1993 and now U.S. Pat. No. 5,634,104; which is a division of application Ser. No. 07/800,631 filed Nov. 27, 1991 and now U.S. Pat. No. 5,288,077 which is a continuation in part of application Ser. No. 07/361,276 filed Jun. 5, 1989 and now U.S. Pat. No. 5,078,405; which is a division of application Ser. No. 07/214,934 filed Jul. 5, 1988 and now U.S. Pat. No. 4,861,041; which is a continuation in part of application Ser. No. 07/182,374 filed Apr. 18, 1988 and now U.S. Pat. No. 4,836,553.

Application Ser. No. 08/408,267 filed Mar. 20, 1995; which is a continuation in part of application Ser. No. 08,328,498 filed Oct. 25, 1994; which is also a division of the aforementioned application Ser. No. 08/040,925 filed Mar. 31, 1993 and now U.S. Pat. No. 5,634,104.

Application Ser. No. 08/140,688 filed Oct. 21, 1993 and now U.S. Pat. No. 5,380,012; which is a continuation in part of application Ser. No. 08/074,301 filed Jun. 9, 1993 and now U.S. Pat. No. 5,374,067; which is a continuation in part of the aforementioned application Ser. No. 07/800,631, filed Nov. 27, 1991 and now U.S. Pat. No. 5,288,077.

Application Ser. No. 08/195,482 filed Feb. 14, 1994 and now U.S. Pat. No. 5,377,973 is a continuation in part of the aforementioned application Ser. No. 08/040,925 filed Mar. 31, 1993 and now U.S. Pat. No. 5,634,104.

Application Ser. No. 08/195,482 filed Feb. 14, 1994 and now U.S. Pat. No. 5,377,973 is also a continuation in part of application Ser. No. 08/074,301 filed Jun. 9, 1993 and now U.S. Pat. No. 5,374,067.

Application Ser. No. 08/195,482 filed Feb. 14, 1994 and now U.S. Pat. No. 5,377,973 is also a continuation in part of application Ser. No. 08/088,785 filed Jul. 8, 1993 and now U.S. Pat. No. 5,282,025; which is a continuation in part of the above referenced application Ser. No. 07/800,631 filed Nov. 27, 1991 and now U.S. Pat. No. 5,288,077.

Application Ser. No. 08/078,602 filed Jun. 16, 1993 and now U.S. Pat. No. 5,634,105; which is a continuation of the aforementioned application Ser. No. 07/800,631 filed Nov. 27, 1991 and now U.S. Pat. No. 5,288,077.

Application Ser. No. 07/443,884 filed Nov. 27, 1989 and now U.S. Pat. No. 4,948,134; which is a division of application Ser. No. 07/218,152 filed Jul. 13, 1988 and now U.S. Pat. No. 5,022,653; which is a continuation in part of the aforementioned application Ser. No. 07/182,374 filed Apr. 18, 1988 and now U.S. Pat. No. 5,377,994.

Application Ser. No. 07/701,670 filed May 16, 1991 and now U.S. Pat. No. 5,112,060.

Application Ser. No. 07/176,384 filed Mar. 31, 1988 and now U.S. Patent No. Des. 311,474.

Application Ser. No. 08/328,498 filed Oct. 25, 1994, now U.S. Pat. No. 5,584,485 and application Ser. No. 08/337,661 filed Nov. 9, 1994, now U.S. Pat. No. 5,626,341, each of which are divisions of Ser. No. 08/40,925 filed Mar. 31, 1993 and now the aforementioned U.S. Pat. No. 5,364,104.

The entire disclosures of each of the above referenced applications and patents are hereby incorporated by reference herein.

BACKGROUND OF THE INVENTION

The present invention generally relates to casino card games including additional jackpot features. More particularly, it relates to methods for playing electronic and live table versions of casino poker games such as seven card stud and five card draw poker games, such as "Caribbean Draw" poker, all of which include optional jackpot features. Various methods and apparatus for introducing a single jackpot component into live casino table games are disclosed in the aforementioned U.S. Pat. Nos. 4,861,041; 5,078,405; 5,584,485 and 5,626,341. Electronic poker games with additional jackpot features are disclosed in U.S. Pat. No. 5,022,653 to Suttle and Jones, which patent is incorporated herein by reference.

SUMMARY OF THE INVENTION

The present invention relates to methods for playing casino card games in which a set of cards are initially dealt and then additional cards are dealt, with provisions being made for a jackpot component awarded after initially dealt cards are reviewed and additional cards are dealt. Predetermined prizes are awarded to players who participate in the jackpot component by placing additional wagers, and the prizes are based upon preselected arrangements of playing cards in the hand after additional cards are dealt.

DETAILED DESCRIPTION OF THE PREFERRED EMBODIMENTS

The present invention relates to improvements to methods for including a jackpot component as an additional feature in a casino card game which includes an initial deal of playing cards to a player, the player's review of the initial set of cards, and the player's receipt of additional cards. The jackpot component is adapted for casino games, such as the commercially available games known as "Caribbean Draw" poker, "Caribbean Seven Card Stud" poker and "Let It Ride" poker.

In a conventional casino draw poker game, a player places a wager to participate in the draw poker game and then receives five cards face down. The player then views the initial set of five cards and then determines whether to stand or draw up to two additional cards. The player must discard a corresponding number of cards, such that the player's resulting hand still equals five total cards.

In accordance with the present invention, the player may participate in a jackpot component in which the player is eligible to receive a prize if the player's initial set of five cards comprises a predetermined arrangement of cards, such as a royal flush, a straight flush, four of a kind, a full house, or a flush, and is also eligible to win a second prize if the player's hand comprises a predetermined arrangement of cards after drawing any additional cards, such as a royal flush, a straight flush, four of a kind, a full house, or a flush, The value of the prizes will typically increase for a higher ranking poker hand. Also, the prizes for the predetermined arrangement of cards after drawing additional cards will typically be less because it is easier for the player to achieve the predetermined arrangement of cards after having the advantage of reviewing the initial five cards and being afforded the option of discarding and drawing additional cards.

In order to participate in the jackpot component, the player may either be required to place at least a minimum value of wager for the underlying draw poker game, may be required to place a separate wager to participate in the jackpot component, or may be extended an option to place a separate wager in order to participate in the jackpot component. Also, the jackpot component may be subdivided into two separate jackpot components—one for the prizes associated with the initial five cards, and a second jackpot component associated with the player's cards after the player has an opportunity to review the initial five cards and to discard and draw additional cards. In this latter embodiment, the player may be required to place two separate additional separate wagers in order to participate in the jackpot component, or the player may be afforded an opportunity to place a separate wager in order to participate in a selected one of either jackpot component, or the player may be afforded an opportunity to participate in the second jackpot component only if the player has placed a separate wager for the first jackpot component It is also contemplated that if there are two separate wagers for each of the two jackpot components, the wagers need not be identical in value, but may be differing values, for example, the wager to participate in the first jackpot component may be one dollar, whereas the wager to participate in the second jackpot component may be fifty cents.

It is within the scope of the instant invention to use a combination of any of the foregoing wagering rules. For example, there might be no minimum wager for the underlying draw poker game (except a minimum established by the house for playing only the draw poker game) in order to participate in the jackpot component, there might be an optional, separate one dollar wager in order to participate in the first jackpot component, and there might be an optional, separate fifty cent wager in order to participate in the second jackpot component.

Preferably, any separate wagers in order to participate in the jackpot component do not affect the play or winnings involved with the underlying draw poker game.

The term "jackpot" is used in this application in its normal sense: (1) a prize or payback for the amount wagered that is much higher relative to other prizes or paybacks commonly associated with the casino game, or (2) a special, substantial prize not available as part of the normal, conventional play of the casino game. For example, a payback of 50 to 1 might be a jackpot for many casino games, but probably not for Roulette, where 35 to 1 paybacks are common. Also, for example, if the prize were one dollar, when the amount wagered is one dollar, such prize would not be considered a jackpot. Preferably , the prize is at least 100 times the value of the wager. The term "jackpot" includes a computer generated random jackpot amount within prescribed minimum and maximum values, and also includes fixed fee amounts, so-called"mystery" amounts, and progressive amounts. The term "jackpot" also includes prizes having a known, fixed monetary value, a known, fixed ratio to the amount wagered, and other awards, such as automobiles or entry tickets to later held tournaments.

As an example, the first jackpot component might pay according to the following pay table for a one dollar separate wager:

| Jackpot Pay Table | Payout |
|---|---|
| Royal Flush | $20,000 |
| Straight Flush | $2,000 |
| Four of a Kind | $200 |
| Full House | $75 |
| Flush | $50 |

The second jackpot component could pay according to a similar payout table, albeit, the monetary awards would be correspondingly lesser, because of the easier odds of obtaining the predetermined arrangement of cards.

Alternatively, each jackpot component might consist of a progressive jackpot which increases in proportion to the amount of each separate wager to participate in the respective jackpot component. Typically, a predetermined, selected percent of the value of the wager is added to the progressive jackpot amount, and any amount not won during one round of the underlying draw poker game is carried over to the next round of the game. Further alternatively, the jackpot component may contain a mixture of a progressive jackpot as well as a fixed fee jackpot. So, for example, the first jackpot component including a mixture of a progressive jackpot and a fixed fee jackpot may provide the following payoff table for a one dollar separate wager:

| Jackpot Pay Table | Payout |
|---|---|
| Royal Flush | 100% of the progressive jackpot |
| Straight Flush | 10% of the progressive jackpot |
| Four of a Kind | $100 |
| Full House | $75 |

Likewise, the second jackpot component may provide a similar payout, with the values of the awards being correspondingly lesser for the same value of the separate wager.

It is also contemplated that there may be a single separate wager in order to participate in both the first and the second jackpot components, or that both separate wagers contribute to a single progressive jackpot. In either of these latter situations, a royal flush for the first jackpot component might win 100% of the progressive jackpot amount, and the royal flush in the second jackpot component might win a lesser percentage, such as 25%, of the progressive jackpot amount.

It is also possible that the player may optionally place a separate wager to participate in the second jackpot component after reviewing the initial five cards, and before receiving any additional draw cards. Such a method would require the player to discard and draw additional cards in order to eliminate the possibility that the player's initial five cards consist of a winning arrangement (other than four of a kind). Also, if a player has won the first jackpot component, the player may be disqualified from participating in the second jackpot component, even if the player has placed a second, separate wager in order to participate in the second jackpot component. For example, the player who has achieved a straight flush from the initial five card deal would stand with such a hand and would collect the prize for the first jackpot component, but would not be permitted to collect any additional prize for a straight flush in connection with the second jackpot component.

In another embodiment of the present invention, the jackpot component may be adapted for use in connection with a seven card stud poker game in which five cards are initially dealt to a player, the player reviews the initial five cards, and then (if the player does not fold) the player is automatically and necessarily provided with two additional cards. Typically, the player selects five of the seven total cards to arrange the highest ranking five card poker hand.

The seven card stud poker game could potentially have values of prizes that are higher in the second jackpot component than the first jackpot component, if the jackpot, instead of being based on the best five card poker hand out of the seven cards, is instead based upon a predetermined arrangements of cards such as a seven card straight flush, a seven card combination of four of a kind suited and three of a kind in the same suit, a seven card flush, etc.

The jackpot feature of the instant invention also may be used in connection with the "Let It Ride" poker game, which is generally described in U.S. Pat. No. 5,288,081, the entire disclosure of which is incorporated herein. In the "Let It Ride" poker game, the player initially receives three cards, and then may choose to remain in the game and receive up to two additional cards in the form of community cards. According to the present invention, the first jackpot component may be won if the player achieves a predetermined arrangement of the initial three cards, such as three of a kind suited, a three card straight, or a three card flush. The second jackpot component may be won if the player achieves a predetermined arrangement of the final five card hand, such as a royal flush, a four of a kind, a five card flush, etc.

Although certain specific, preferred embodiments of the present invention have been described above, it should be appreciated that the instant invention may be adapted to any casino game in which an initial set of cards is dealt, a player reviews the initial set of cards, and then the player receives additional cards.

It should also be appreciated that the instant invention is adaptable for either a live table game with a human dealer as well as electronic, video games. It is further contemplated that the instant casino game may be played on a personal computer or on the Internet without "real" wagers being won or lost, but rather with the wagers being simulated. Such simulation of wagers is included within the scope of the instant "casino game."

When the instant invention is utilized in connection with a live casino table game, it is contemplated that (1) coin/token/chip acceptors, such as those associated with the "Caribbean Stud" table game, the IGT "Progressive Blackjack" table game offered in New Jersey in the early 1990s, and the ShuffleMaster "Let-It-Ride—The Tournament" or "Let-It-Ride—Bonus Bet" table games, or such as those described in U.S. Pat. No. 4,861,041 to Jones, et al. and U.S. Pat. No. 5,393,067 to IGT; (2) player selection button acceptors, such as those described in U.S. Pat. No. 5,472,194 to Breeding, et al., or (3) credit or debit card acceptors, may be utilized whereby the placement of a wager to participate in the jackpot component may be electronically recognized. Either one or two of such acceptors may be positioned at each player location at a table and a light indicator may be selectively turned on or off to indicate the placement of a wager. Furthermore, each of the wagers placed for the jackpot component may be recorded sequentially, like an odometer. Controllers and progressive jackpot meters such as those associated with the aforementioned games of those described in U.S. Pat. Nos. 4,861,041 and 5,393,067 may also be utilized in connection with the present invention in a conventional, well-known manner.

Although particular embodiments of the present invention have been described and illustrated herein, it should be recognized that modifications and variations may readily occur to those skilled in the art and that such modifications and variations may be made without departing from the spirit and scope of my invention. Consequently, my invention as claimed below may be practiced otherwise than as specifically described above.

What is claimed is:

1. A method of including a jackpot component as an additional feature in a card game wherein said game includes an initial deal of playing cards to a player and wherein the player may optionally discard cards from the initial hand and draw a corresponding number of replacement cards, comprising the steps of:

(a) a player making a first wager to participate only in the game, whereby if the player achieves a winning condition in the game the player wins a game prize;

(b) the player optionally making a second wager to participate in the jackpot component;

(c) dealing an initial set of playing cards to the player; and (d) if the player has made the second wager, and if the player's hand comprises a first winning arrangement of cards, the player wins a first prize, the improvement comprising:

(1) the addition of a second jackpot component based upon the player's resulting hand after the player exercises an option to discard at least one card from his hand and draw a corresponding number of replacement cards, with the player optionally making a third wager before such discarding and drawing of cards to participate in said second jackpot component, and winning a second prize if the player has made the third wager and if the player's resulting hand after receiving the replacement cards comprises a second winning arrangement of cards, whereby the player may win both (i) said game prize, and (ii) either or both of said first prize and said second prize.

2. The method of claim 1, wherein said second prize comprises at least one hundred times the value of said third wager.

3. The method of claim 1, wherein said second prize comprises a preselected percentage of said first prize.

4. The method of claim 1, wherein said first prize comprises a preselected percentage of a progressive jackpot in which the amount of said progressive jackpot increases incrementally with said second wager.

5. The method of claim 1, wherein said second prize comprises a preselected percentage of a progressive jackpot in which the amount of said progressive jackpot increases incrementally with said third wager.

6. The method of claim 1, wherein said first prize comprises a fixed fee.

7. The method of claim 1, wherein said second prize comprises a fixed fee.

8. The method of claim 1, wherein said second wager contributes only to said first jackpot component and not to said casino game or to said second jackpot component.

9. The method of claim 1, wherein said third wager contributes only to said second jackpot component and not to said casino game or to said first jackpot component.

10. The method of claim 1, wherein the player may make said third wager only if the player has made said second wager.

11. The method of claim 1, wherein said casino game consists essentially of draw poker.

12. The method of claim 1, wherein said casino game comprises a video game in which said cards are displayed on a video screen.

13. The method of claim 1, wherein the player wins said first prize if the initial set of cards consists of a predetermined arrangement of cards and the player wins said second prize if the player's hand after receiving the replacement cards consists of a second predetermined arrangement of cards.

14. The method of claim 1 wherein the monetary values of said second wager and said third wager differ.

15. The method of claim 1, wherein the initial hand consists of five cards.

16. The method of claim 1, wherein the resulting hand consists of five cards.

17. A method of including a jackpot component as an additional feature in a game wherein said game includes an initial deal of playing cards to a player and wherein the player receives additional cards after viewing said initial deal, comprising the steps of:

(a) a player making a first wager to participate only in the game, whereby if the player achieves a winning a winning condition in the game the player wins a game prize;

(b) the player optionally making a second wager to participate in the jackpot component;

(c) dealing an initial set of playing cards to the player; and (d) if the player has made the second wager, and if the initial set of cards comprises a first winning arrangement of cards, the player wins a first prize, the improvement comprising;

(1) the addition of a second jackpot component based upon the player's resulting hand after the player receives additional cards, with the player optionally making a third wager before receiving the additional cards to participate in said second jackpot component, and winning a second prize if the player has made the third wager, and if the player's resulting hand after receiving the additional cards comprises a second winning arrangement of cards, whereby the player may win both (i) said game prize, and (ii) either or both of said first prize and said second prize.

18. The method of claim 17, wherein said second prize comprises at least one hundred times the value of said third wager.

19. The method of claim 17, wherein said second prize comprises a preselected percentage of said first prize.

20. The method of claim 17, wherein said first prize comprises a preselected percentage of a progressive jackpot in which the amount of said progressive jackpot increases in proportion to said second wager.

21. The method of claim 17, wherein said second prize comprises a preselected percentage of a progressive jackpot in which the amount of said progressive jackpot increases in proportion to said third wager.

22. The method of claim 17, wherein the initial deal comprises at least three cards, and wherein the player receives either one or two additional cards.

23. The method of claim 17, wherein the initial deal consists of five cards.

24. The method of claim 17, wherein said first prize comprises a fixed fee.

25. The method of claim 17, wherein said second prize comprises a fixed fee.

26. The method of claim 17, wherein said second wager contributes only to said first jackpot component and not to said casino game or to said second jackpot component.

27. The method of claim 17, wherein said third wager contributes only to said second jackpot component and not to said casino game or to said first jackpot component.

28. The method of claim 17, wherein the player may make said third wager only if the player has made the second wager.

29. The method of claim 17, wherein said casino game consists essentially of draw poker.

30. The method of claim 17, wherein said casino game consists essentially of Caribbean 7 Card Stud™ poker.

31. The method of claim 17, wherein said casino game consists essentially of Caribbean Draw™ poker.

32. The method of claim 17, wherein said casino game consists essentially of Let It Ride™ poker.

33. The method of claim 17, wherein said casino game comprises a video game in which said cards are displayed on a video screen.

34. The method of claim 17, wherein the player wins said first prize if the initial set of cards consists of a first winning arrangement of cards and the player wins said second prize if the player's resulting hand after receiving the additional cards consists of a second winning arrangement of cards.

35. The method of claim 17, wherein said casino game comprises a live casino table game.

36. The method of claim 17, wherein the initial deal consists of three cards and wherein the resulting hand consists of five cards.

37. The method of claim 17, wherein the initial deal consists of five cards and the resulting hand comprises seven cards.

38. The method of claim 17, wherein the initial deal consists of five cards and the resulting hand consists of five cards.

39. A method of including a jackpot component as an additional feature in a game wherein said game includes an initial deal of at least three cards to a player and wherein the player receives additional cards after viewing said initial deal, comprising the steps of:

(a) the player making a first wager to participate in the game, whereby if the player achieves a winning condition in the game the player wins a game prize;

(b) dealing an initial set of at least three cards to the player;

(c) permitting the player to view the initial set of cards;

(d) the player optionally making a second wager to participate in the jackpot component after the player has viewed the initial set of cards and before receiving additional cards;

(e) dealing additional cards to the player after the player has viewed the initial set of cards and after the player has optionally made said second wager; and (f) if the player has made the second wager, and if the player's hand after receiving the additional cards comprises a winning arrangement of cards, then the player wins a first prize, whereby the player may win both (i) said game prize and (ii) said first prize.

40. The method of claim 39, wherein said game consists essentially of draw poker.

41. The method of claim 39, wherein said game consists essentially of CaribbeanDraw™ poker.

42. The method of claim 39, wherein said game consists essentially of stud poker.

43. The method of claim 39, wherein said game consists essentially of Let It Ride™ poker.

44. A method of including a jackpot component as an additional feature in a game wherein said game includes an initial deal of cards to a player and wherein the player receives additional cards, comprising the steps of:

(a) the player making a first wager to participate only in the game, whereby if the player achieves a winning condition in the game the player wins a game prize;

(b) the player optionally making a second wager to participate in the jackpot component;

(c) after steps (a) and (b), dealing an initial set of cards to the player;

(d) permitting the player to view the initial set of cards;

(e) if the player has placed said second wager, and if the player's initial set of cards comprises a first winning arrangement of cards, then the player receives a first prize separate from said game prize;

(f) dealing additional cards to the player after the player has viewed the initial set of cards; and (g) if the player has placed a second wager, and if the player's resulting hand after receiving the additional cards comprises a second winning arrangement of cards, then the player wins a second prize separate from said game prize, whereby the player may win both (i) said game prize, and (ii) either or both of said first prize and said second prize.

45. A method of including a jackpot component as an additional feature in a card game wherein said game includes an initial deal of playing cards to a player and wherein the player may optionally discard cards from the initial hand and draw a corresponding number of replacement cards, comprising the steps of:

(a) a player making a first wager to participate only in the game, (b) the player optionally making a second wager to participate in the jackpot component;

(c) dealing only from a single, standard 52 card deck of cards an initial set of playing cards to the player; and (d) if the player has made the second wager, and if the player's hand comprises a first winning arrangement of cards, the player wins a first prize, the improvement comprising:

(1) the addition of a second jackpot component based upon the player's resulting hand after the player exercises an option to discard at least one card from his hand and draw a corresponding number of replacement cards only from said deck, with the player optionally making a third wager before such discarding and drawing of cards to participate in said second jackpot component, and winning a second prize if the player has made the third wager and if the player's resulting hand after receiving the replacement cards only from said deck comprises a second winning arrangement of cards.

46. A method of including a jackpot component as an additional feature in a game wherein said game includes an initial deal of playing cards to a player and wherein the player receives additional cards after viewing said initial deal, comprising the steps of:

(a) a player making a first wager to participate only in the game;

(b) the player optionally making a second wager to participate in the jackpot component;

(c) dealing only from a single, standard 52 card deck of cards an initial set of playing cards to the player; and (d) if the player has made the second wager, and if the initial set of cards comprises a first winning arrangement of cards, the player wins a first prize, the improvement comprising;

(1) the addition of a second jackpot component based upon the player's resulting hand after the player receives additional cards only from said deck, with the player optionally making a third wager before receiving the additional cards to participate in said second jackpot component, and winning a second prize if the player has made the third wager, and if the player's resulting hand after receiving the additional cards only from said deck comprises a second winning arrangement of cards.

47. A method of including a jackpot component as an additional feature in a game wherein said game includes an initial deal of at least three cards to a player and wherein the player receives additional cards after viewing said initial deal, comprising the steps of:

(a) the player making a first wager to participate in the game;

(b) dealing only from a single, standard 52 card deck of cards an initial set of at least three cards to the player;

(c) permitting the player to view the initial set of cards;

(d) the player optionally making a second wager to participate in the jackpot component after the player has viewed the initial set of cards and before receiving additional cards;

(e) dealing only from said deck additional cards to the player after the player has viewed the initial set of cards and after the player has optionally made said second wager; and (f) if the player has made the second wager, and if the player's hand after receiving the additional cards comprises a winning arrangement of cards, then the player wins a prize.

48. A method of including a jackpot component as an additional feature in a game wherein said game includes an initial deal of playing cards to a player and wherein the player receives additional cards, comprising the steps of:

(a) the player making a first wager to participate only in the game, whereby if the player achieves a winning condition in the game the player wins a game prize;

(b) the player optionally making a second wager to participate in the jackpot component;

(c) after steps (a) and (b), dealing only from a single, standard 52 card deck of cards an initial set of cards to the player;

(d) permitting the player to view the initial set of cards;

(e) if the player has placed said second wager, and if the player's initial set of cards comprises a first winning arrangement of cards, then the player receives a first prize separate from said game prize;

(f) dealing only from said deck additional cards to the player after the player has viewed the initial set of cards; and (g) if the player has placed said second wager, and if the player's hand after receiving additional cards comprises a winning arrangement of cards, then the player wins a second prize separate from said game prize.

* * * * *